United States Patent [19]

Curtis

[11] Patent Number: 4,544,157

[45] Date of Patent: Oct. 1, 1985

[54] GOALKEEPER'S HOCKEY STOCK WITH BENT SHAFT

[75] Inventor: Martin D. Curtis, Bolton, Canada

[73] Assignee: Curtis Hockey Inc., Bolton, Canada

[21] Appl. No.: 486,126

[22] Filed: Apr. 18, 1983

[30] Foreign Application Priority Data

Mar. 10, 1983 [CA] Canada ..... 423259

[51] Int. Cl.[4] ..... A63B 59/12

[52] U.S. Cl. ..... 273/67 A; D21/210

[58] Field of Search ..... 273/67 A, 67 C, 67 DA, 273/67 DB, 67 DC, 67 R, 81.3, 80 C; D21/210–216

[56] References Cited

U.S. PATENT DOCUMENTS

| | | | |
|---|---|---|---|
| D. 256,824 | 9/1980 | Ward et al. | 273/81.3 |
| D. 263,329 | 3/1982 | Clayton | D21/210 |
| 1,183,473 | 5/1916 | McNiece | 273/67 A |
| 1,979,174 | 10/1934 | Robertson | 273/81.3 |

FOREIGN PATENT DOCUMENTS

| | | | |
|---|---|---|---|
| 250829 | 4/1964 | Australia | 273/81.3 |
| 273438 | 8/1927 | Canada . | |

*Primary Examiner*—Richard C. Pinkham
*Assistant Examiner*—Matthew L. Schneider

[57] ABSTRACT

A goalkeeper's hockey stick having a blade and a shaft rigidly connected to the blade at the heel end. The shaft has three sections with a first section being straight and extending upwards from the heel end of the blade. A second section forms first and second bends with the first bend causing the shaft to extend upwardly and rearwardly from the first section and the second bend causing the shaft above the second bend to extend substantially parallel to the first section. The third section is straight and extends upwards from said second bend. Preferably the shaft has a slight transverse curve near its upper end which results in a deviation from the plane defined by the blade and the first section of the shaft of about 1 inch.

10 Claims, 6 Drawing Figures

GOALKEEPER'S HOCKEY STOCK WITH BENT SHAFT

BACKGROUND OF THE INVENTION

This application relates to sticks suitable for playing the sport of hockey.

Hockey sticks have up until now tended to be very similar in their design and construction. They are generally made of wood which may be solid or laminated. Generally speaking the blade of the stick is laminated in order to provide the desired curvature in the blade portion. Most shafts on the other hand are of a solid wood construction. The governing bodies of the various hockey leagues generally lay down rules for the construction of hockey sticks to be used in their leagues. For example, the National Hockey League specifies in its rule book that no hockey stick shall exceed 58 inches in length from the heel to the end of the shaft and no more than 12½ inches from the heel to the end of the blade. Furthermore, according to the rule book of this league the blade must not be more than 3 inches in width at any point nor less than 2 inches. Also all edges of the blade must be bevelled and the curvature of the blade must not exceed a certain maximum.

In addition to the standard stick used by defencemen and the forwards, the goalkeeper has a special stick used to block shots on goal. This stick generally has a wider blade and a widened portion extending up the shaft from the blade. The National Hockey League rules for this type of stick include the requirements that the blade not exceed 3½ inches in width at any point except at the heel where it must not exceed 4½ inches in width. Further, the blade must not exceed 15½ inches in length from the heel to the opposite end. The widened portion of a goalkeeper's stick must extend up the shaft not more than 26 inches from the heel and it must not exceed 3½ inches in width. As with ordinary sticks, a goalkeeper's stick may or may not have a curved blade. Some goalkeepers prefer that the blade have no curvature at all.

Certain problems can arise with the use of a goalkeeper's stick constructed in the usual manner. Some of these problems arise from the fact that the narrow portion of the shaft, which is the upper portion, extends from the center of the widened portion. Because of this arrangement, a goalkeeper cannot have the same perception of where the lower part of the stick is, such as the heel of the blade, as a player using an ordinary stick. Furthermore, the standard goalkeeper's stick does not shoot the puck like a regular hockey stick and thus the goalkeeper may not have sufficient control and accuracy when handling the puck such as when the puck must be cleared.

Another difficulty with the standard stick used by goalkeepers is that if the back edge of the stick is placed along the ice surface in an effort to block a shot, the back surface does not lie flat along the ice and there is a large gap between the upper end of the widened portion of the shaft and the upper end of the narrow portion of the shaft. A hockey puck can easily slide through this gap and cause a goal to be scored.

It is an object of the present invention to provide an improved hockey stick of novel construction. The present invention is particularly suited for incorporation into sticks suitable for use by hockey goalkeepers but it also can be used with advantage in sticks designed for defencemen and offensive forwards.

It is a further object of the invention to provide a goalkeeper's stick for the game of ice hockey that is better able to block a puck when the shaft of the stick is laid along the ice and that is more comfortable to hold for an extended period of time.

It is another object of the present invention to provide a hockey stick with a slight sideways curve in the shaft, which stick is better able to clear the net post and the crossbar on the net when it is used by a goalkeeper.

SUMMARY OF THE INVENTION

According to the present invention a hockey stick comprises a blade and a shaft rigidly connected to the blade. The shaft has three sections with the first section extending upwards from the blade. A second section forms first and second bends, the first bend causing the shaft to extend rearwardly from said first section and said second bend causing the shaft above the second bend to extend substantially parallel to the first section when said sections are viewed from a side of the stick. A third section extends upwards from the second bend. The first and third sections are straight when they are viewed from a side of the stick.

Preferably the first section of the shaft includes a widened portion which is of increased width in the plane defined by the blade. An upper portion of the shaft, located above the widened section, is of reduced width and has a rectangular cross-section. A rear side of the upper portion is longitudinally aligned with and parallel to a rear edge of the widened portion.

According to another aspect of the invention, a hockey stick comprises a blade and a shaft connected to said blade at one end of said blade, said shaft having five sections including a first section extending upwards from said blade, a second section having first and second bends, said first bend causing said shaft to extend rearwardly from said first section and said second bend causing the shaft above the second bend to extend substantially parallel to said first section when said sections are viewed from a side of the stick, and a third section extending upwards from said second bend, a fourth section having third and fourth bends, said third bend causing said shaft to extend forwardly from said third section and said fourth bend causing said shaft above said fourth bend to extend substantially parallel to said third section when the stick is viewed from the side thereof, and a fifth section extending upwards from said fourth bend, wherein said first and third sections are straight when they are viewed from the side of said stick.

According to a further aspect of the present invention, a hockey stick comprises a blade and a shaft rigidly connected to the blade at one end thereof, wherein the shaft has a slight sideways curve.

Preferably the sideways curve results in a deviation at the upper end of the shaft from the plane defined by the blade and the lower portion of the shaft of approximately 1 inch. According to a particular preferred embodiment disclosed herein, a stick with a sideways curve is a goalkeeper's stick having a widened portion extending up the shaft from the blade.

Further features and advantages will be apparent from the following detailed description taken in conjunction with the accompanying drawings wherein:

DETAILED DESCRIPTION OF PREFERRED EMBODIMENTS

Figure 1:
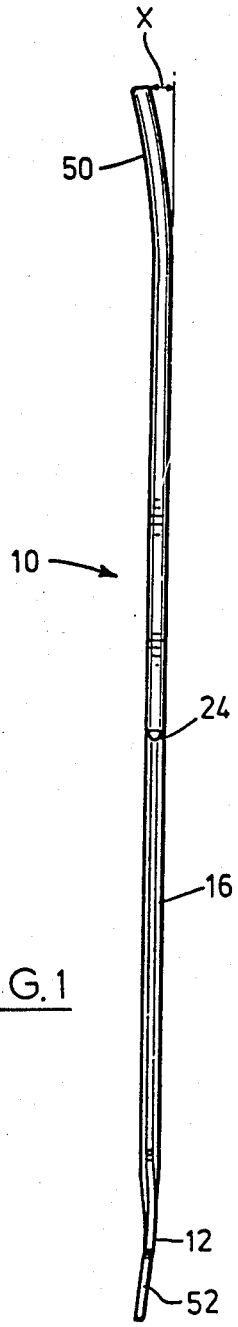
FIG. 1 is a front edge view of a goalkeeper's stick constructed in accordance with the present invention.
Figure 2:
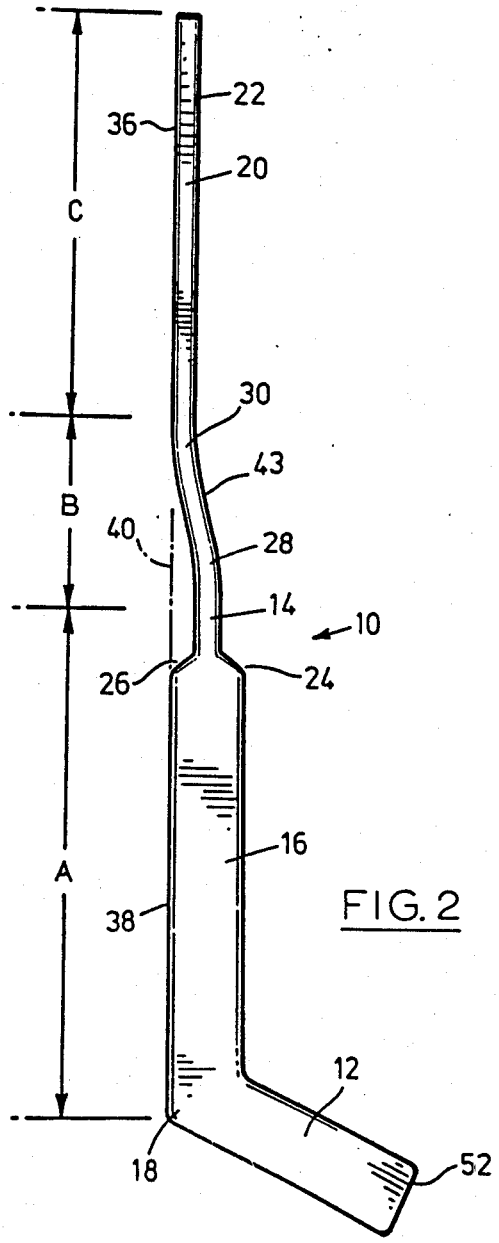
FIG. 2 is a side view of a goalkeeper's stick shown in FIG. 1.
Figure 3:
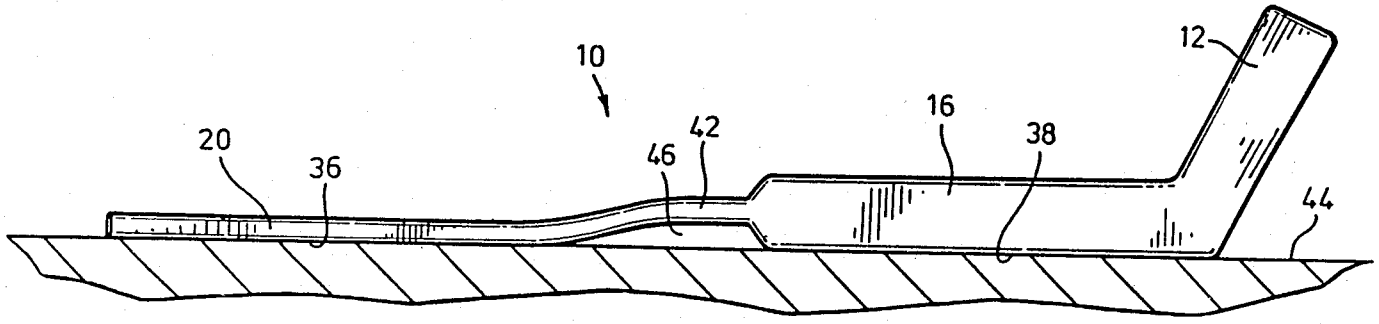
FIG. 3 is an illustration of how the present goalkeeper's stick can be used to block a shot by laying the rear side of the shaft along the ice.

The hockey stick 10 shown in FIGS. 1 to 3 is intended for use by a goalkeeper in the game of ice hockey. Many of its features are similar to those of previously used goalkeeper's sticks. The stick includes a relatively wide blade 12 at the bottom and a shaft 14 rigidly connected to the blade. Hockey sticks are generally made from wood and may be of solid or laminated construction. A goalkeeper's stick has a shaft with a widened portion 16 that extends upwardly from the heel of the stick located at 18. A major portion of the shaft has relatively narrow cross-sectional dimensions. This narrower portion 20 generally has a rectangular cross-section and chamfered edges 22 both at the front two edges and at the two rear edges of the shaft. As in the prior art goalkeeper's sticks, the narrow portion 20 of the shaft connects to the widened portion 16 midway between the front top corner 24 and the rear top corner 26.

Figure 6:
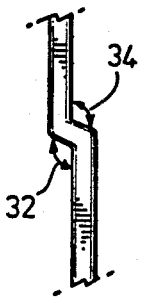
FIG. 6 is a detail view of the center section of an alternative embodiment of the present invention.

A goalkeeper's stick in accordance with the present invention has a shaft which can be divided into at least three sections indicated by the letters A, B, and C in FIG. 2. The first section A extends upwards from the heel end of the blade 12 and includes the aforementioned widened portion 16 of the shaft. It may also include a short section of the narrow portion of the shaft. A second section B forms first and second bends 28 and 30. These bends can either be smooth curves as shown in FIGS. 2 and 3 or they can be relatively sharp corners. If the bends are formed by sharp corners, it is preferred that the bends form obtuse angles, that is angles greater than 90° as shown in FIG. 6 of the drawings. These obtuse angles are indicated at 32 and 34 in FIG. 6. The use of smooth curves to form bends 28 and 30 is preferred over the use of sharp corners as it permits the hand of the player to slide easily along the shaft in the region of the second section B. The first bend 28 causes the shaft to extend at least rearwardly from the first section A. Preferably the first bend causes the shaft to extend both upwardly and rearwardly as shown. The second bend 30 causes the shaft above the second bend to extend substantially parallel to the first section A. The third section of the shaft extends upwards from the second bend 30. It will be seen that both the first and third sections are straight when they are viewed from a side of the stick (that is from the left or right side).

It will be seen from FIGS. 2 and 3 that because of bends 28 and 30 in the stick of the present invention, the rear surface 36 of the narrow third section of the shaft is longitudinally aligned with and parallel to the rear edge 38 of the widened portion 16. In other words, a longitudinal line 40 extending upwardly from and forming an extension of the rear edge 38 lies in the plane of the rear surface 36. Because of this feature, the goalkeeper's stick of the present invention is better able to block a shot on goal when positioned along the ice as shown in FIG. 3. The goalkeeper can hold the stick at 42 while the rear surface 36 of the third section C rests on the ice surface 44. At the same time the rear edge 38 of the widened portion of the shaft rests on the ice surface. Because the goalie's hand substantially fills the gap 46, a substantially continuous blocking surface is formed by the stick from one end of the shaft to the other. Thus the stick of the present invention is better able to block a puck that is travelling along the surface of the ice. With a goalkeeper's stick of the prior art wherein the narrow upper portion of the shaft is straight, there is a much larger gap formed between the upper portion of the shaft and the ice surface when the stick is placed in the same position as the stick shown in FIG. 3.

Another advantage of the present goalkeeper's stick for many goalies arises from the fact that the upper section C of the shaft is lined up with the heel 18 of the stick (in the same manner as a regular hockey stick used by defencemen and offensive players). For this reason the goalie has an improved perception of where the heel of his stick is located, which perception can be very important when attempting to block a shot with the blade of the stick. Guesswork by the goalkeeper is thus reduced and there is better control of "eye" (seeing the shot coming toward him) and "hand" (moving the stick as required) coordination. Furthermore, because the upper section C is aligned with the heel 18 in the same manner as a regular stick, the present goalkeeper's stick shoots more like a regular stick. Goalkeepers may also obtain better leverage with a stick constructed in accordance with the present invention and this in turn can result in better control when pucks are being cleared and more accurate shots by the goalie. Because of the bends at 28 and 30 and the fact that the narrow portion of the shaft can be gripped at the offset portion located at 42, use of a goalkeeper's stick constructed in accordance with the invention may also assist the goalie with poke checking or drawing the stick back as it is maneuvered to block or stop shots on goal. The preferred illustrated stick handles easier because of the diagonal section 43. This section allows the goalkeeper's wrist to be in a more natural position, thus reducing pressure and strain on his wrist and making the stick much easier to handle. More control may also be achieved because the goalkeeper can determine how far up or down the shaft his "blocker hand" is simply by feeling the curve in the shaft. Also the rear side of bend 30 provides a good shape for holding and manouvering the stick with the pocket of the goalkeeper's catching glove. The glove will hold the stick in "spoon-like" fashion and thus give the goalkeeper more control in handling the stick and shooting the puck.

Figure 4:
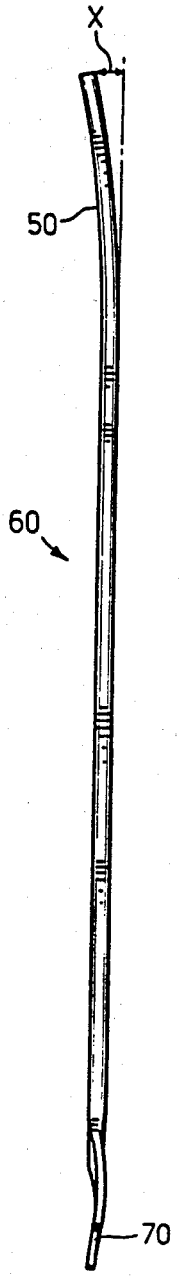
FIG. 4 is a front view of a hockey stick constructed in accordance with this invention and intended for use by a defenceman or offensive player.
Figure 5:
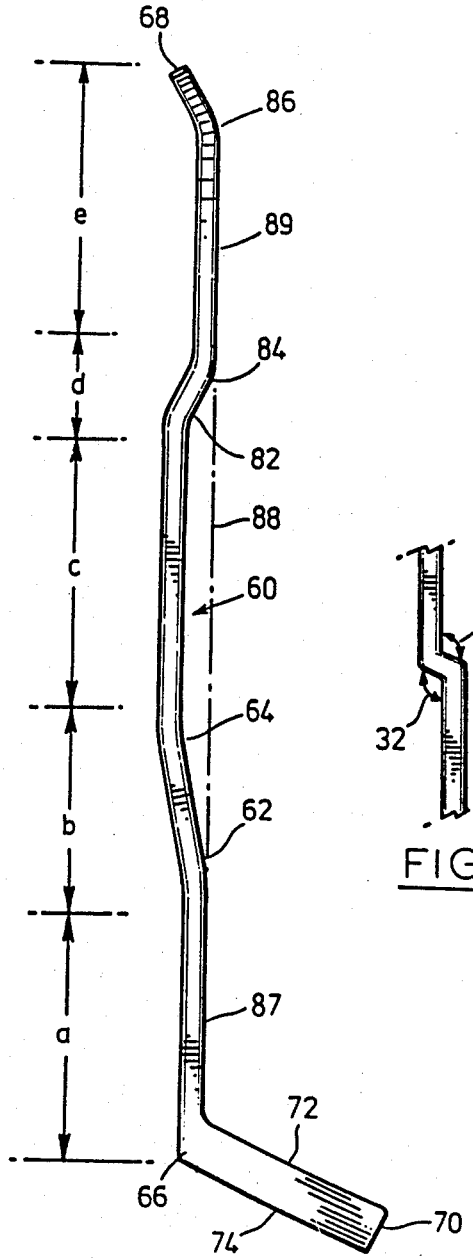
FIG. 5 is a side view of the hockey stick shown in FIG. 4.

Another aspect of the present invention is illustrated in FIG. 1 of the drawings. The stick 10 is provided with a slight transverse or sideways curve 50 in the region of the upper end of the shaft 14. It is preferred that the deviation of the upper end of the stick from the plane defined by the blade 12 and the first section A of the shaft be 1 inch. This deviation is indicated by the letter X in FIG. 1. The sideways curve can also be usefully employed in a stick designed for use by defencemen and offensive players. A stick 60 for use by these players is shown in FIGS. 4 and 5. In this stick also, the maximum and preferred deviation at the upper end of the shaft from the plane defined by the blade and the lower portion of the shaft is again 1 inch. This maximum deviation is indicated by the letter X in FIG. 4. The usefulness of the sideways curve in the shaft both in a standard stick and in a goalkeeper's stick will be readily apparent when one considers how the stick is handled when a player is shooting the puck. The stick is held with both hands so that it is positioned in front of the player's body and legs. The blade is flicked outwards quickly to hit the puck in the desired direction. The outward movement of the blade results in the corresponding inward movement of the upper end of the shaft. Particularly when the stick is positioned close to the player's body, there will be less interference between the player's body and the upper end of the shaft when the stick has the transverse curve shown in FIGS. 1 and 4. The direction of the curve depends on whether the player uses a right handed or left handed stick. The stick will be curved at its upper end so that the upper end curves away from the player's body.

The amount of and the location of the transverse curve in the stick can be varied and depends to a large extent on a particular player's preferences. The curve need not necessarily be located near the upper end of the shaft although this position may be preferred by most players. With respect to the amount of curvature, it is expected that the maximum amount will be regulated by the hockey leagues in which these sticks are used. The sideways curve is particularly useful for a goalkeeper who is restricted in shooting the puck because he wears a catching glove on one hand and this hand cannot firmly grip the stick. The sideways curvature provides added leverage when he shoots the puck. This stick also clears the net post and crossbar better than presently used sticks.

As indicated above, the two bends 28 and 30 are preferably smooth curves. These curves may either have a long or a short radius of curvature. In a particular preferred embodiment the bends 28 and 30 are curves with radius of curvature exceeding 8 inches. In this preferred embodiment the third section C is shorter in length than the first section A as illustrated in FIG. 2.

As indicated above, the various hockey leagues have rules governing what constitutes an acceptable hockey stick. One league that has rigid rules concerning both regular sticks and goalkeeper's sticks is the National Hockey League. According to the rule book of this league the blade 12 of a goalkeeper's stick shall not exceed 3½ inches in width at any point except at the heel 18. At the heel the blade must not exceed 4½ inches in width. Furthermore, the blade 12 must not exceed 15½ inches in length from the heel to the end 52 of the blade. The widened portion 16 extending up the shaft must not extend more than 26 inches from the heel 18 and must not exceed 3½ inches in width.

The stick 60 suitable for use by a defenceman or a forward shown in FIGS. 4 and 5 in addition to having the aforementioned transverse curve in the shaft, is provided with first and second bends 62 and 64. Again these bends can either be sharp corners or smooth curves. The stick 60 has a shaft that can be divided into five sections indicated by letters a, b, c, d and e in FIG. 5. The first section a extends upwards from the heel 66 of the blade while the second section includes the aforementioned first and second bends 62 and 64. In the illustrated preferred embodiment the first bend 62 begins approximately 15 inches from the heel. Preferably the first bend 62 causes the shaft to extend both upwardly and rearwardly as shown. The second bend 64 causes the shaft above the second bend to extend substantially parallel to the first section a. The third section c extends upwards from the second bend 64 to the start of the third bend 82. In a stick constructed for an adult, the third bend 82 would begin approximately 39 inches from the heel 66. The fourth section d comprises the third bend 82 and the fourth bend 84. The third bend 82 causes the shaft to extend forwardly from the third section c and the fourth bend 84 causes the shaft above the fourth bend to extend substantially parallel to the third section c when the stick is viewed from the side thereof. In the illustrated preferred embodiment, the third bend causes the shaft to extend both forwardly and upwardly from the third section c. The fifth section e extends upwards from the fourth bend. Both the first and third sections a and c are straight when they are viewed from the side of the stick (see FIG. 5). Preferably all four of the aforementioned bends are smooth curves formed in the shaft. Also the fifth section e preferably has a lower portion and an upper portion that extends to the top of the stick with the lower portion being straight and the upper portion curving rearwardly from the lower portion as these portions are viewed from the side of the stick. The upper portion thus forms a fifth bend 86 which in an adult stick is approximately 7 inches from the top end of the shaft. It will be appreciated by those skilled in the art that the distance from the heel to each bend varies as it is dependent upon the size of the player. The reason for the five bends 62, 64, 82, 84 and 86 is that these bends make the stick easier to handle than a stick constructed with the standard straight shaft. It is also possible to obtain better puck control.

The use of a stick constructed as shown in FIGS. 4 and 5 is particularly desirable in face-off situations in the game of hockey. The stick can be held in one of two possible ways with both hands. According to the first method for holding the stick, one hand is placed at bends 62 and 64 and the other hand is placed at bends 82 and 84. According to the alternative method, one hand is placed on bends 62 and 64 and the other hand is placed on the fifth bend 86. Better control can also be obtained when only one hand is being used to manoeuvre the stick. In this case the single hand can be positioned on the diagonal section located between the fifth bend 86 and the end of the shaft 68.

Preferably the forward surface of the first section a lies in the same plane as the forward surface 89 of the straight lower portion of the section e. Thus a longitudinal line 88 extending upwardly from and forming an extension of the forward surface 87 lies in the plane of the forward surface 89. This alignment provides the player with a good perception of where the heel of his stick is located. Thus despite the bends in the stick there is a good "eye" and "hand" coordination obtainable with the use of this stick.

The dimensions of the stick shown in FIGS. 4 and 5 are such that they comply with the rules of the league in which the stick is being used. In the case of the National Hockey League the stick must not exceed 58 inches in length from the heel to the end 68. The length of the blade from the heel to the end 70 must not exceed 12½ inches while the width of the blade must not exceed 3 inches from the top 72 to the bottom 74.

It will be readily apparent to those skilled in the art that various modifications and changes could be made to the described hockey sticks without departing from the spirit and scope of this invention. All such changes and modifications falling within the terms of the appended claims are intended by the applicant to be covered herein.

What I claim as my invention is:

1. A goalkeeper's hockey stick comprising: a blade having a heel end; a shaft having a first end and a second end, said first end being connected to said heel end of said blade and said second end being free, said blade extending to one side of the shaft; said shaft having a widened lower portion near said first end and a narrowed upper portion near said free end, said widened portion being widened in the plane of the blade, said narrowed upper portion extending from the termination of said widened lower portion to said free end, said narrowed upper portion and said widened lower portion having rear surfaces located on the opposite side of the shaft from which the blade extends;

said narrowed upper shaft portion including a bent region adjacent said widened lower shaft portion, said bent region causing the rear surface of said narrowed upper shaft portion above said bent region to be longitudinally aligned with the rear surface of said widened lower shaft portion and said heel of said blade.

2. A goalkeeper's hockey stick as claimed in claim 1 wherein said bent region of said upper shaft portion includes a first rearward bend and a second upward bend in the direction of said free end causing the rear surface of said upper shaft portion above said bent region to align with the heel end of the blade.

3. A hockey stick according to claim 2 wherein said first and second bends are smooth curves formed in said shaft.

4. A hockey stick according to claim 2 wherein said first and second bends are curves with a radius of curvature exceeding 8 inches.

5. A goalkeeper's hockey stick as claimed in claim 1 wherein said upper shaft portion includes a short straight segment between said bent region and said widened lower shaft portion.

6. A goalkeeper's hockey stick as claimed in claim 5 wherein said narrowed upper shaft portion is of substantially constant width from said widened lower shaft portion to the upper end of said shaft.

7. A goalkeeper's hockey stick as claimed in claim 5 wherein said short straight segment of said upper shaft portion is coaxial with said widened lower shaft portion, said upper shaft portion above said bent region being generally parallel to and rearwardly offset from said short straight segment of said upper shaft portion.

8. A hockey stick according to claim 1 wherein said upper shaft portion has a slight transverse curve causing the upper end of said shaft to be located out of the plane defined by said blade and by said lower portion of said shaft.

9. A hockey stick according to claim 1 wherein said shaft has a slight transverse curve resulting in a maximum deviation from the plane defined by said blade and the widened lower portion of said shaft of 1 inch.

10. A hockey stick according to claim 1 wherein said blade has a height from top to bottom of between 3 and $3\frac{1}{2}$ inches and said widened portion of said shaft has a maximum width of $3\frac{1}{2}$ inches.

* * * * *